United States Patent [19]

Mattes

[11] Patent Number: 4,741,054

[45] Date of Patent: May 3, 1988

[54] CHIN CUP FOR USE WITH MILITARY HEADGEAR

[75] Inventor: Paul B. Mattes, Garland, Tex.

[73] Assignee: Varo, Inc., Garland, Tex.

[21] Appl. No.: 6,023

[22] Filed: Jan. 22, 1987

[51] Int. Cl.[4] ..... A42B 3/00

[52] U.S. Cl. ..... 2/421; 2/6; 428/919

[58] Field of Search ..... 2/421, 424, 425, 9, 2/10, 6, 185 R, 199, 412; 428/919

[56] References Cited

U.S. PATENT DOCUMENTS 3,166,761 1/1965 Strohm ..... 2/421

3,916,446 11/1975 Gooding ..... 2/421

4,446,576 5/1984 Hisataka ..... 2/9 X 4,465,731 8/1984 Pusch et al. ..... 428/919 X

*Primary Examiner*—Peter Nerbun

*Attorney, Agent, or Firm*—Jerry W. Mills; Roger N. Chauza

[57] ABSTRACT

A chin cup arrangement (10) is disclosed having a foam chin cup (32). The chin cup foam (32) is adhered to a canvas interface (33). The composite foam and canvas structure is coated with a vinyl/nitrile mixture, pigmented to a dark color with a finely powered carbon. A pair of straps (20, 26) are then sewn to the contoured composite foam/canvas cup.

10 Claims, 1 Drawing Sheet

CHIN CUP FOR USE WITH MILITARY HEADGEAR

RELATED APPLICATION

"Replaceable Cushion Liner for Headgear," by Paul B. Mattes, Ser. No. 006,734, filed concurrently herewith.

TECHNICAL FIELD OF THE INVENTION

The present invention relates in general to helmets and headgear equipment, and more particularly, relates to methods and apparatus for fixing such equipment to a person's head.

BACKGROUND OF THE INVENTION

Headdress or headgear equipment have long been a normal part of military attire to protect the wearer, as well as to support equipment thereon. Headgear apparatus for supporting night vision equipment, and over which protective helmets can be worn is illustrated in U.S. application Ser. No. 808,152 now U.S. Pat. No. 4,703,879 filed Dec. 12, 1985, and assigned to the Assignee hereof.

In the noted application, a chin cup and strap arrangement are provided for securing the headgear to the wearer's head. A chin cup constructed of leather, sewn to canvas straps or webbing has been developed, and is well known in the art, for use with the noted headgear. Because of the direct contact of the chin cup with the facial tissue of the wearer, military specifications require a non-allergenic leather to protect against skin or tissue reactions due to the skin sensitivities of various individuals. Presently, the only source of a leather which fulfills the specification is from a hairless sheep found only in Nigeria, Sudan, and various other foreign countries. Because of the tanning process and chemicals involved, such leather cannot be processed in the United States. Accordingly, the leather material is expensive, and often in limited supply.

Helmets used in athletic events often utilize chin cups and associated straps for fastening to the wearer's head. Such chin cups have been constructed of an ordinary cowhide leather and sewn to canvas strap webbing. More recently, chin cups used in connection with sports helmets are preformed foam covered with a vinyl/nitrile non-allergenic coating. The sports headgear securing apparatus is not well adapted for use with military equipment.

From the foregoing, it can be seen that a need exists for an improved chin cup and material which is easily available, cost effective, and which does not compromise any of the advantages presented by the materials heretofore used.

SUMMARY OF THE INVENTION

In accordance with the present invention, the disclosed chin cup reduces or substantially eliminates the disadvantages and shortcomings associated with the prior art devices. According to the chin cup of the invention, a closed cell, dense foam is stamped into a desired shape, and formed into a cup-shaped contour. A canvas patch is adhered to the foam to provide a structural integrity thereto. The composite foam and canvas patch is then dipped into a vinyl/nitrile liquid, and allowed to dry or cure. The vinyl/nitrile includes a pigment material, such as carbon, to provide a black vinyl/nitrile mixture which is non-synthetic in nature, and thus naturally non-allergenic.

A pair of elongate nylon straps are sewn to the vinyl/nitrile covered canvas patch and foam cup. To provide support, a first nylon strap is anchored to the upper part of the headgear and is sewn around the center part of the contoured chin cup. A second nylon strap which is anchored to the lower rear part of the headgear and fastened around the upper contoured part of the chin cup.

BRIEF DESCRIPTION OF THE DRAWINGS

Further features and advantages will become more apparent from the following and more particular description of the preferred embodiment of the invention, as illustrated in the accompanying drawing in which like referenced characters generally refer to the same parts throughout the views, and in which.

DETAILED DESCRIPTION OF THE INVENTION

Figure 1:
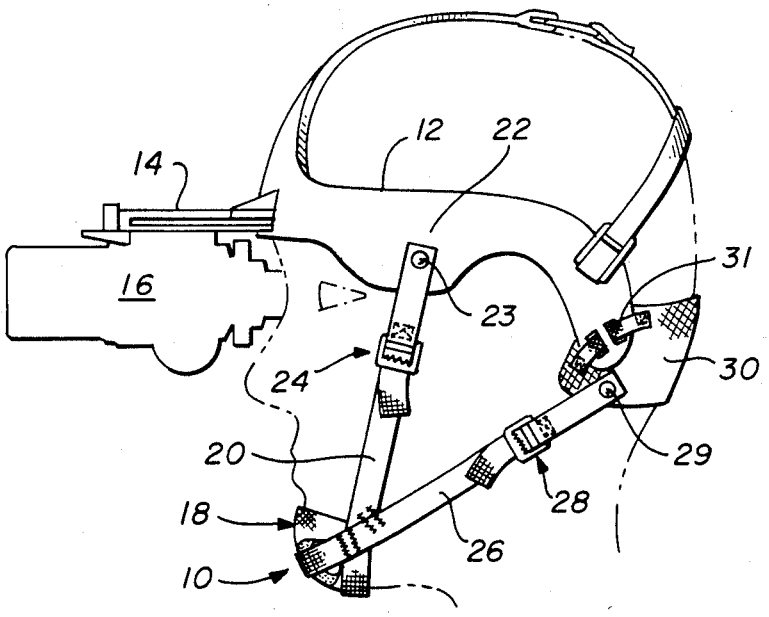
FIG. 1 is a side elevational view of a headgear type with which the chin cup of the invention can be advantageously used.

FIG. 1 illustrates an application in which the chin cup of the invention may be advantageously practiced. Shown is a chin cup and strap arrangement 10 for holding a headgear 12 secured to the wearer. The illustrated head-gear 12 is of the type having a cantilever support 14 for supporting night vision equipment 16 proximate the wearer's eyes.

The chin cup arrangement 10 includes a cup 18 to which a first strap 20 is fixed for securing a chin cup 18 with respect to an upper part 22 of the headgear 12. Strap 20 includes buckle assembly 24 and is connected to the headgear 12 by a snap fastener 23. A lower strap 26 is also connected to the chin cup 18, and is anchored through an adjustable buckle arrangement 28 to the posterior portion of the wearer's head. Snap 29 allows the end of the strap 26 to be removably attached to a webbing 30 which wraps araound the posterior of the wearer's head and is anchored at the ends thereof to the headgear frame 12. A short section of a strap 31 is threaded through parallel slots in the headgear frame 12 and sewn to the webbing 30. The chin cup 18 is thus fixed with respect to the headgear 12 so that such headgear can be firmly secured to the person's head.

Figure 2:
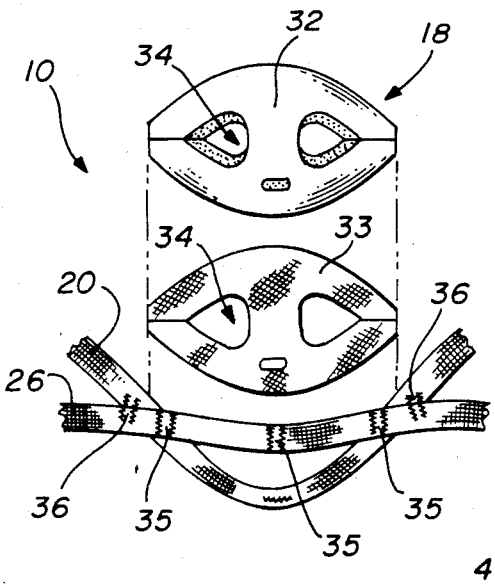
FIG. 2 is an exploded view of the components of the chin cup constructed in accordance with the invention.

FIG. 2 depicts the chin cup arrangement 10 with the components thereof removed from each other for clarity of understanding. The chin cup 18 comprises a section of closed-cell foam 32, contoured to form a cup-like structure similar to the curvature of a person's chin. The foam 32 is selected preferably with a closed cell material and a 3–6 pound density. With this type of foam, the cell pores are small and tightly packed together. A canvas patch 33 is cemented to the foam 32. The patch 33 is of suitable strength to provide the chin cup 18 with the necessary integrity for fastening the straps 20 and 26 thereto. Apertures or holes 34 may be formed in both the foam 32 and the canvas patch 33. The composite foam and canvas chin cup 18 is then dip coated in a vinyl/nitrile liquid to seal and protect the foam from the environment, as well as provide a non-allergenic interface to the chin tissue of the wearer.

For military applications, the vinyl/nitrile is to be constructed per military specification ASTM D-1667-81. The vinyl/nitrile material can be obtained from ADCO Company, Box 489, Cookville, Tenn. A black or dark pigmentation may be added to the vinyl/nitrile to transform the liquid from a natural white color to a dark or black color. A finely powdered carbon may be added to the vinyl/nitrile mixture to achieve such coloration. When used in connection with military headgear, the chin cup 18 should be dark colored to prevent light reflections in conditions of low visibility such as night time, and thus prevent the easy location of the head gear wearer by the enemy. Other pigment materials which are also non-allergenic can also be used with equal effectiveness.

Importantly, the vinyl/nitrile coating on the foam chin cup 18 permits the chin cup to be easily cleaned, and prevents the deterioration of the underlying foam rubber due to moisture and skin oils from the wearer. Equally important, the coated high density foam provides a substantially smooth and slick surface which is easy to clean, and is softer and more comfortable than conventional leather chin cups, as the foam rubber conforms to the chin contours of the wearer. Most significantly, the chin cup of the invention is by far less costly and more readily available than the rare non-allergenic leathers identified above.

With reference again to FIG. 2, and as noted above, the chin cup 18 may include apertures 34 for allowing the passage of aiar therethrough and thus afford a more comfortable chin cup 18. The apertures also facilitate the formation of the foam 32 into a cup-like structure. The chin cup arrangement 10 is further constructed by sewing a first nylon strap or webbing 20 and a second nylon strap 26 to the canvas covered foam 32 at the locations identified by reference numeral 35. The first and second straps 20 and 26 are then sewn together, and not to the foam and canvas patch, at locations identified by reference character 36. The canvas patch 33 is of sufficient size to fit over a large portion of the foam chin cup 18 and thus afford a suitable foundation for the stitching 35. The stitching 35 is preferably dense or double stitched so that the possibility of moisture entering the foam core through the stitch holes is reduced.

As noted in FIGS. 1 and 2, the first chin strap 20 is fastened with respect to the foam chin cup 18 so that it passes generally around the peaked part of the contour. The chin cup 18 thus provides a full cushioning support for resisting the removal of the headgear 12 in an upwardly direction. Similarly, the second strap 26 is fixed with respect to the top frontal part of the contoured chin cup 18 to provide a lateral circumferential support of the headgear with respect to the posterior portion of the wearer's head. While the snaps 23 and 29 and buckle arrangements 24 and 28 are shown for adjusting and securing the chin cup arrangement 10 to the headgear 12, other fastening techniques can be used with equal effectiveness.

Figure 3:
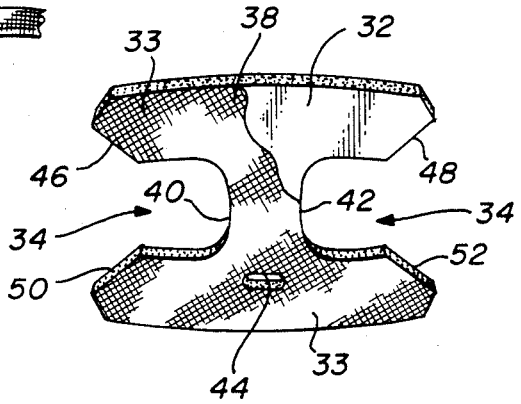
FIG. 3 is an isometric view of a stamped composite foam and canvas part of the chin cup.

FIG. 3 illustrates a composite foam and canvas blank 38 stamped from a sheet of the composite material, prior to its formation into a contoured structure. The sheet of composite material is formed by adhering a sheet of canvas to a sheet of the closed cell foam. The cement or adhering agent is allowed to dry. The chin cup composite core 38 is stamped from the flat material, in the shape shown in FIG. 3. The core blank 38 includes recesses 40 and 42 which form the air circulation apertures 34. Aperture 44 is also formed. The blank 38 also includes edges 46 and 48 associated respectively with edges 50 and 52. In order to facilitate the formation of a contoured structure, the edges 46 and 50 of the blank 38 are brought together and adhered with a cement, or other suitable bonding material. Associated edges 48 and 52 are similarly brought together and bonded. When the respective edges 46 and 50, and 48 and 52, are bonded together, the composite blank 38 assumes a contoured form. The recesses 40 and 42 then become closed apertures 34. To facilitate the contour formation of the chin cup 18, the recesses 40 and 42 in the composite blank 38 may be formed with shapes other than that shown in FIG. 3.

From the foregoing, an improved chin cup for use with a headgear is disclosed. The chin cup includes a foam cup structure for providing a cushion between securing straps and the chin of the wearer. Furthermore, the foam chin cup is coated with a non-allergenic and inexpensive vinyl/nitrile material. In the preferred form of the invention, the vinyl/nitrile coating is dark colored to reduce light reflections, and thus reduce the visible detection thereof.

While the preferred embodiment of the invention has been disclosed with reference to a specific chin cup arrangement, it is to be understood that many changes in detail may be made as a matter of engineering choices without departing from the spirit or scope of the invention, as defined by the appended claims.

What is claimed is:

1. A chin cup for use with a headgear, comprising:

a high density foam material contoured similar to the chin of a wearer;

a nonstretchable canvas material bonded to said foam, said canvas material and said foam material having apertures for air circulation therethrough;

a coating of a dark colored vinyl/nitrile material covering said foam and said canvas material to form a smooth non-allergenic surface; and a strap arrangement fixed to said bonded canvas and foam material, said strap being adapted for fastening to the headgear.

2. The chin cup of claim 1 wherein said vinyl/nitrile includes a powdered carbon to provide a dark color.

3. The chin cup of claim 1 wherein said foam comprises 3–6 pound density foam rubber.

4. The chin cup of claim 1 wherein said strap arrangement comprises a pair of straps fastened to said foam chin cup so that said straps follow different contours over said contoured chin cup.

5. The chin cup of claim 4 wherein said straps are fixed to said contoured chin cup so as to provide lateral and vertical support thereto.

6. A chin cup for use with a headgear, comprising:

a cup-shaped foam material contoured similar to the chin of a wearer, said foam comprising of a 3–6 pound density foam material;

a canvas material adhered to the outer surface of said foam material, said canvas material and said foam material having apertures for air circulation therethrough and for allowing forming of said materials into a contoured shape cup;

a vinyl/nitrile and carbon material coating said foam and said canvas material to provide a smooth dark colored non-allergenic exterior surface;

a first nylon strap sewn to said adhered canvas material and foam in a position such that said first strap follows a first contoured surface of said chin cup; and a second nylon strap sewn to said adhered canvas material and foam and to said first strap in such a manner as to follow a different contoured surface of said chin cup.

7. A method of fabricating a chin cup assembly for use with a headgear, comprising the steps of:

forming a composite sheet of material by fastening a sheet of high density foam to a sheet of canvas;

stamping a blank out of said composite sheet material, said blank having apertures for allowing the blank to be formed into a contoured article;

forming said blank into contoured shape;

coating said contoured blank with a dark colored vinyl/nitrile liquid to provide a low reflectivity non-allergenic article;

curing the liquid vinyl/nitrile; and fastening a strap to said contoured blank to form said chin cup.

8. The method of claim 7 further including mixing a powdered carbon material with said vinyl/nitrile liquid to provide a dark colored composition.

9. The method of claim 7 further including fastening a pair of straps together and then fastening said pair to said contoured blank.

10. The method of claim 7 wherein said canvas is fastened to said foam by an adhesive.

* * * * *